United States Patent [19]

Youtt et al.

[11] Patent Number: 4,697,618

[45] Date of Patent: Oct. 6, 1987

[54] CONTAINER STRUCTURE FOR DANGEROUS MATERIAL

[75] Inventors: Stanley A. Youtt, Avon Lake; John W. Dixon, Newbury, both of Ohio

[73] Assignee: The American Tank & Fabricating Co., Cleveland, Ohio

[21] Appl. No.: 689,294

[22] Filed: Jan. 7, 1985

[51] Int. Cl.[4] ..... B65D 25/18; B65D 90/34; F16K 24/02; F17C 3/02

[52] U.S. Cl. ..... 137/587; 137/74; 137/590; 220/1 B; 220/18; 220/71; 220/88 R; 220/89 B; 220/428; 220/435

[58] Field of Search ..... 220/426, 428, 88 R, 220/89 B, 1 B, 71, 435, 18; 137/587, 72, 74, 581, 264, 375, 590; 52/167, 173 R, 174; 404/6, 8; 280/5 D

[56] References Cited

U.S. PATENT DOCUMENTS

| | | | |
|---|---|---|---|
| 64,123 | 4/1867 | McGarry | 220/428 |
| 1,401,002 | 12/1921 | Smith | 220/89 B |
| 1,417,605 | 5/1922 | Johnston | 220/89 B X |
| 1,689,917 | 10/1928 | Geisinger | 220/426 X |
| 1,737,929 | 12/1929 | Libby | 280/5 D |
| 1,779,786 | 10/1930 | Unzue | 220/428 |
| 1,950,234 | 3/1934 | Ewertz | 220/428 |
| 1,951,741 | 3/1934 | Smith | 280/5 D |
| 2,558,694 | 6/1951 | Speis | 220/428 |
| 2,577,171 | 12/1951 | Wissins et al. | 220/427 |
| 2,687,618 | 8/1954 | Bersstrom | 220/88 R X |
| 2,922,287 | 1/1960 | Rae | 220/426 X |
| 3,471,053 | 10/1969 | Endicott et al. | 220/1 B X |
| 4,068,777 | 1/1978 | Humphrey et al. | 220/1 B |
| 4,469,129 | 9/1984 | Dixon | 220/428 |

*Primary Examiner*—Allan N. Shoap

*Attorney, Agent, or Firm*—Renner, Otto, Boisselle & Lyon

[57] ABSTRACT

A container structure for a dangerous material. An inner container defines a chamber for receiving the dangerous material, an outer container surrounds the inner container, and a fluid chamber is disposed between the inner and outer containers. A body of non flammable liquid is disposed in and completely fills the fluid chamber, and the body of liquid is substantially confined in the fluid chamber. A vent space is disposed between the inner and outer containers in the area above the fluid chamber. The outer container has a bottom wall that is adapted to slidably engage a support surface so that the container structure can slide on the support surface in response to an external impact overcoming its inertia. The inner container is supported essentially by the body of liquid in the fluid chamber, and the body of liquid, being substantially confined in the fluid chamber, distributes impact forces applied to the outer container over a large area of the inner container, thus minimizing damage to the inner container in response to an external impact, and allowing the container structure to slide as a solid body on the support surface in response to an external impact that overcomes its inertia.

13 Claims, 7 Drawing Figures

CONTAINER STRUCTURE FOR DANGEROUS MATERIAL

BACKGROUND

This application relates to a container structure for a dangerous material such as gasoline, pesticide, toxic waste, etc. It relates particularly to a container structure which is especially designed to resist a direct impact thereon without becoming damaged and causing its contents to be released into the environment. Further, it relates to a container structure which minimizes heat transfer to the dangerous material in the event of an external fire.

Through the years, it has been conventional to store dangerous material such as gasoline, pesticide, toxic waste, etc. in tanks that are buried in the ground. However, a problem which has surfaced in connection with tanks that are buried in the ground is leakage of the dangerous material into the ground, and contamination of the environment and aquifer.

There have also been suggestions for providing above-ground storage facilities for dangerous materials such as gasoline. For example, U.S. Pat. No. 2,558,694 discloses an example of an above ground storage apparatus for gasoline. In that patent, an outer container having a volume of water surrounds an inner container that contains the gasoline. The water if freely flowable in the outer container. In the event of a fire, water is caused to flow through the outer container to dissipate heat.

Further, Dixon U.S. Pat. No. 4,469,129 discloses another type of above-ground container structure for dangerous material. The principal structure of the Dixon patent is an inner container for the dangerous material, an outer container surrounds the inner container, a normally static body of water disposed between the containers, and a layer of closed cell insulation secured to the inner container. The principal function of the structure disclosed in the Dixon patent is to minimize heat transfer to the dangerous material stored in the inner container, and to minimize leakage of dangerous material out of the inner container.

With above ground container structures for dangerous materials, an important problem that has to be addressed is crash protection. Often, such container structures are, of necessity, located in areas where heavy vehicles (e.g. trucks) operate. Thus, there is always a possibility of a heavy vehicle such as a truck directly impacting the container structure. If an impact causes the contents of the container structure to spill into the environment, the results can be very destructive. The Dixon patent specifically suggests the provision of a crash protection ring around the container structure to help minimize the likelihood of damage to the container structure due to an impact. Further, the Dixon patent discloses an embodiment in which the container structure may rest on the ground, and applicants believe that such a container structure may be able to slide somewhat if directly impacted by a vehicle. However, in the Dixon patent, the body of water between the inner and outer containers can be substantially displaced in the event of an impact. Thus, the containers can shift relative to each other in the event of an impact. An impact from a truck moving at a significant rate (e.g. 30 m.p.h.) may displace the containers sufficiently to damage the inner container, and cause its contents to spill into the environment.

SUMMARY OF THE PRESENT INVENTION

The present invention relates to a new and improved above ground container structure which is designed to withstand a relatively heavy direct impact thereon, without spilling its contents into the environment. The present invention provides a container structure which should be able to withstand a direct impact from a truck moving at a relatively high speed (e.g. about 35 mph.) without being damaged to the point where its contents are spilled into the environment.

The container structure of the invention comprises an inner container, an outer container, and a special fluid chamber disposed between the inner and outer containers. The inner container is designed to receive the dangerous material. The outer container surrounds the inner container, and the fluid chamber surrounds the sides and the bottom of the inner container. There is a body of a non-flammable liquid (e.g. water) disposed in and completely filling the fluid chamber, and which body of liquid is substantially confined in the fluid chamber so that little, if any, of the liquid can be displaced in the event of an impact on the container structure. The inner container is supported essentially by the body of liquid in the fluid chamber. The outer container has a bottom wall that is adapted to slidably engage a support surface, so that the container structure can slide on the support surface in response to an external impact overcoming its inertia. Since the body of liquid is substantially confined in the fluid chamber, and essentially supports the inner container, a direct impact on the outer container will cause fluid reaction forces to be distributed over a large area of the inner container, thus minimizng relative movement of the inner and outer containers, and causing the entire container structure to slide as a solid body when it is impacted. By distributing impact forces over a large area of the inner container, and causing the container structure to slide as a solid body when impacted, the likelihood of the container structure (particularly the inner container) becoming deformed or punctured by the impact is minimized. Thus the danger of the inner container being damaged, and spilling its contents to the environment, is greatly reduced.

Also, according to the preferred form of the present invention, the container structure has additional features designed to minimize heat transfer to the inner container in the event of an external fire. There is a vent space disposed between the inner and outer containers, in the area above the fluid chamber, and the fluid chamber is communicated with the vent space in the event the temperature of the liquid in the fluid chamber reaches a predetermined level. Specifically, there is a sealing means that normally seals the fluid chamber from the vent space. In the event the temperature of the liquid in the fluid chamber reaches a predetermined level, part of the sealing means is destroyed, to communicate the fluid chamber with the vent space. Once the liquid in the fluid chamber is communicated with the vent space, the liquid in the fluid chamber can evaporate to the atmosphere, to minimize heat transmission to the inner container.

Further, according to the preferred embodiment, the outer container has an impact ring secured directly to it for receiving the initial force of an impact of a vehicle. The impact ring projects outwardly from the outer container, at a location that is below the center of gravity of the container structure. The impact ring is disposed at a level which ensures that, in the case of an impact from a vehicle, the impact ring is the first part of the container structure contacted by the vehicle. The impact ring distributes the impact load and also causes the line of action of the impact force to be directed below the center of gravity of the container structure. This causes a moment to be applied to the container structure that overcomes its inertia, and initially tilts the portion of the container structure remote from the impact point upward. The initial tilting of the container structure helps free the container structure for sliding movement under continued application of the impacting force.

The further features and advantages of the present invention will be further apparent from the following detailed description taken with respect to the accompanying drawings.

DETAILED DESCRIPTION OF THE PREFERRED EMBODIMENT

As discussed above, the container structure of the present invention is useful in containing a dangerous material such as gasoline, pesticide, toxic waste, etc. In the description which follows, the principles of the invention are described in connection with a container structure for gasoline. However, the manner in which the principles of the invention can br applied to a container structure for other dangerous materials will become readily apparent to those of ordinary skill in the art.

Figure 1:
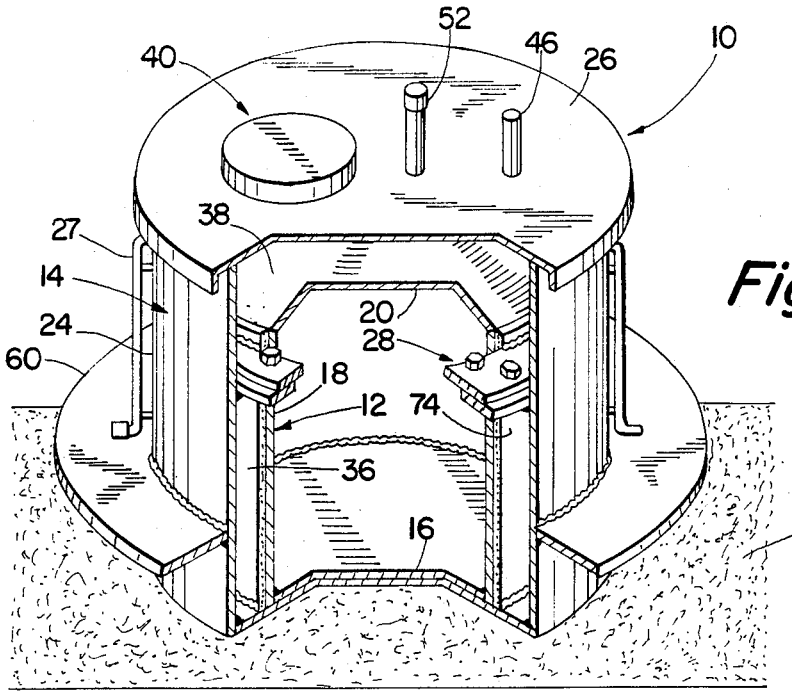
FIG. 1 is an isometric view of a container structure embodying the principles of this invention, with fragmentary portions removed.
Figure 2:
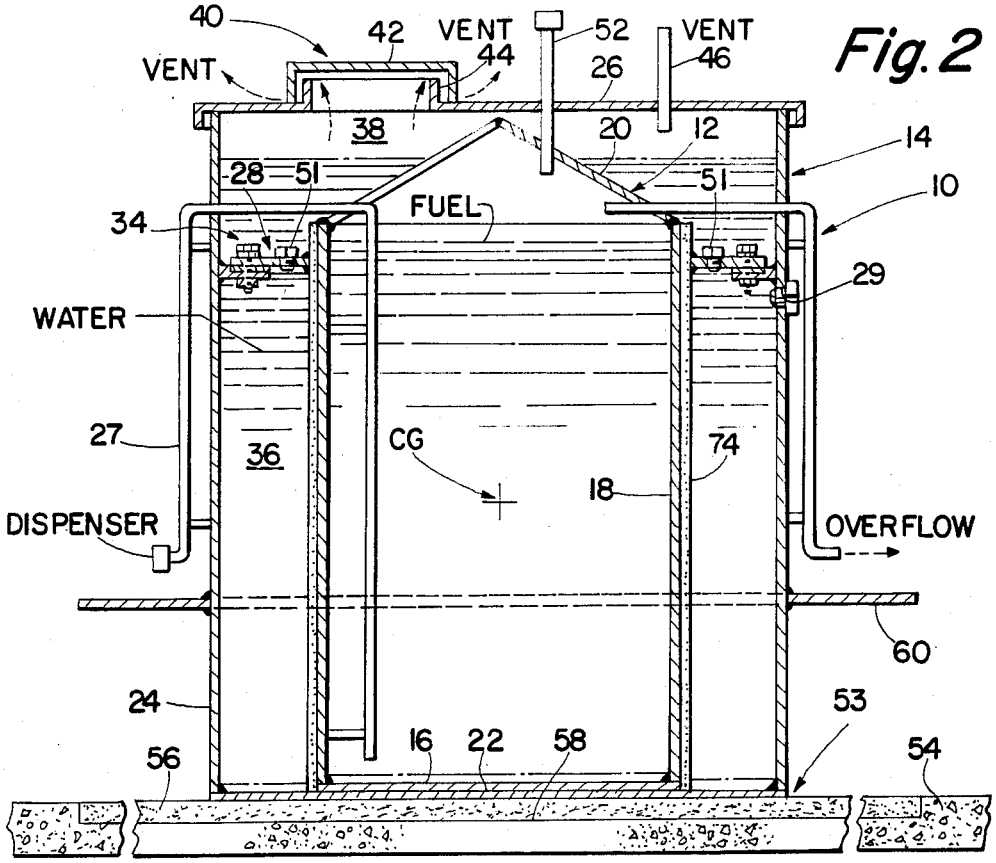
FIG. 2 is a sectional view of the container structure of FIG. 1.

As shown in FIGS. 1 and 2, a container structure 10 according to the present invention comprises an inner container 12, and an outer container 14 that surrounds the inner container 12. The inner container 12 has a bottom wall 16, a cylindrical side wall 18 extending upward from the bottom wall 16, and a conically shaped top wall 20. The outer container 14 has a bottom wall 22 disposed below the bottom wall 16 of the inner container 12, a cylindrical side wall 24 that surrounds the side wall 18 of the inner container, and a relatively flat top wall 26. Where the material contained in the inner container 18 is gasoline, a dispensing means, schematically shown at 27, can be provided for dispensing metered amounts of the gasoline, e.g. into the gas tanks of vehicles.

The walls of the inner and outer containers are preferably formed of steel, but it is contemplated that the walls of the inner container can also be made of special alloys or of plastic (e.g. for corrosion resistance). The bottom and side walls 16, 18 of the inner container 12 are welded together to provide a liquid-tight seal. Also, the bottom and side walls 22, 24 of the outer container 14 are welded together to form a liquid-tight seal.

Figure 2A:
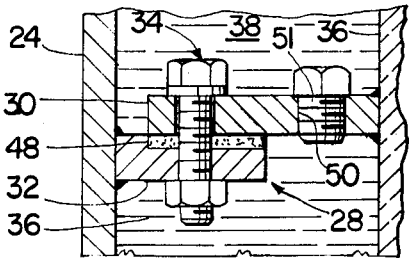
FIG. 2A is an enlarged, fragmentary view of a portion of FIG. 2, showing the wall means disposed between the fluid chamber and the vent space.

The space between the inner and outer containers is divided into two sections by an annular wall means 28 (FIGS. 2, 2A) that extends between the inner and outer containers, near the top of the side wall 14 of the inner container 12. The wall means 28 preferably comprises a pair of overlapped, annular steel flanges 30, 32 extending away from the steel side walls 18, 24 of the inner and outer containers, respectively. The overlapped flanges 30, 32 are secured together by series of bolts 34 (FIG. 2A).

The annular wall means 28 divides the space between the inner and outer containers into two portions. A fluid chamber 36 is defined in the space below the wall means 28, and a vent space 38 is defined in the space above the wall means 28. A fill opening 29 may be provided in the side wall 24 of the outer container to allow the fluid chamber conveniently to be filled with aqueous liquid (preferably a mixture of water and an anti-freeze material). Further, the aqueous liquid also preferably occupies a portion of the vent space 38 disposed above the fluid chamber 36.

In this application, there are references to the fluid chamber 36 as being "substantially enclosed", and/or to the aqueous liquid in the fluid chamber being "substantially confined". Both of those expressions are intended to define a condition that is at the heart of this invention; i.e., that, other than during the filling process, there is normally either (i) no fluid communication between the fluid chamber 36 and the vent space 38 or (ii) sufficient restriction to the flow of liquid from the fluid chamber to the vent space such that the volume of liquid that could be extruded from the fluid chamber during an impact is less than the volume that would be occupied by the impact deformation imparted to the outer container during the impact. Thus, the liquid in the fluid chamber distributes the impact forces, rather than absorbing the impact forces by extrusion and/or displacement.

A vent means 40 communicates the vent space 38 to the atmosphere. Thus, vapors in the vent space 38 are vented to the atmosphere. In the preferred embodiment, the vent means 40 is formed by a steel cap 42 that fits loosely on an upwardly extending cylindrical flange 44 on the top wall 26 of the outer container 14. One or more spacers (not shown) may be disposed between the cap 42 and the flange 44, to help maintain constant communication between the vent space 38 and the atmosphere. Further, it is contemplated that, if necessary or desirable, an additional vent means (shown schematically at 46 in FIG. 2) can be provided in the top wall 26 of the outer container 14 for providing additional venting of the vent space 38 to the atmosphere.

The fluid chamber 36 is completely filled with a liquid, preferably a non-flammble, aqueous liquid. The overlapping flanges 30, 32 of the wall means 28 have an annular seal 48 between them (FIG. 2A), to partially seal the fluid chamber 36 disposed below the wall means 28. Further, at spaced locations about its periphery, the wall means 28 has a series of internally threaded openings 50. The openings 50 extend from the fluid chamber 36 to the vent space 38. Each of the openings 50 is normally sealed by a threaded plug 51 made of a material called "Woods Metal" a "Wood Fusible Alloy" and comprising e.g. 50% Bi, 12.5% Sn, 25% Pb, 12.5% Cd. The metal plugs 51 normally seal the openings 50, and, along with the annular seal 48, seal the fluid chamber 36 from the vent space 38.

The non-flammable liquid normally fills the entire fluid chamber 36 and extends partially into the vent space 38. The fluid chamber 36 can be filled with liquid through the fill opening 29 in the side wall 24. Alternatively, the fluid chamber 36 can be filled with liquid by depositing the liquid into the vent space 38 through the top of the container structure and allowing the liquid to flow through the openings 50 (before the plugs 51 are inserted). Still further, it is contemplated that there may be check valves associated with one or more of the openings 50. The check valves would allow flow from the vent space 38 to the fluid chamber 36 in order to allow filling of the chamber 36, and to allow any fluid which leaks from the chamber to be replenished from the vent space 38. The check valves would close if the container structure is impacted, to completely confine the liquid in the chamber 36. The check valves could be gravity operated valves that are biased open by gravity, and are closed by the pressure of the non-flammable liquid in the fluid chamber when the non-flammable liquid completely fills the fluid chamber. The closure of the check valves could also be electrically controlled (e.g. by respective solenoids), and an accelerometer disposed on the outer container would sense an impact and send an appropriate signal to the check valves to close the check valves and shut off communication between the vent space and the fluid chamber.

The bottom wall 16 of the inner cylinder 12 preferably is disposed above the bottom wall 22 of the outer container 14. The fluid chamber 36 includes the space between the bottom walls of the inner and outer containers. When the fluid chamber 36 is filled with liquid, it may cause the bottom wall 16 of the inner container to be slightly spaced above the bottom wall 22 of the outer container. Further, if the material inside the inner container 12 is a vaporizable liquid such as gasoline, a vent means (shown at 52 in FIG. 2) may be provided for venting the inner container 12 to the atmosphere.

When a body of non-flammable aqueous liquid is filling the fluid chamber 36, and is substantially confined in the fluid chamber, the inner container 12 is essentially supported by the fluid in the fluid chamber 36. The only mechanical connecting means that exists between the inner and outer containers is the wall means 28 extending between the containers near the top of the inner container 12. The bottom wall 16 of the inner container 12 will either rest on the bottom wall 22 of the outer container 14, or will be spaced slightly above the bottom wall 22 of the outer container.

The bottom wall 22 of the outer container 14 rests on a support surface 53 and is adapted to slide on the support surface 53. Preferably, the ground provides a base 54, and a layer or bed 56 of sand is disposed in a slight recess 58 in the base 54. The top of the bed of sand 56 forms the support surface 53. The depth of the recess 58 in the base 54, and the thickness of the bed of sand 56 in the recess 58, are designed so that the support surface 53 is at, or near, ground level. The container structure 10 can slide along the support surface 53 in response to an external impact on the container structure.

In the preferred embodiment, an annular steel rim 60 extends outward from the cylindrical side wall 24 of the outer container 14. As seen in FIG. 2, the annular rim 60 is disposed low enough that it should be normally below the center of gravity C.G. of the container structure, regardless of how much or how little material is in the inner container 12. Preferably, the annular rim 60 is a solid steel member that is welded or otherwise fixed to the side wall 24 of the outer container 14. However, it is also contemplated that the annular rim 60 could have a hydraulic, or other type of spring means to provide it with some type of resilient, damped response to an impact.

It is preferred that the liquid in chamber 36 be completely confined in that chamber. However, under certain circumstances it is acceptable, and may even be desirable, to have some small communication exist between the chamber 36 and the vent space 38, while still substantially restricting fluid flow from the fluid chamber 36 to the vent space. However, the restriction must be sufficient so that in the event of an impact on the outer container the volume of liquid that could be forced (extruded) from the chamber 36 into the vent space 38 is less than the volume that would be occupied by the impact deformation imparted to the outer container during the impact. Thus, the liquid does not dampen impacts primarily by extrusion or by displacement. Rather, the confined liquid causes distribution of the shock waves of an impact in a way that causes the container structure to react like a solid body to the impact.

Figure 3:
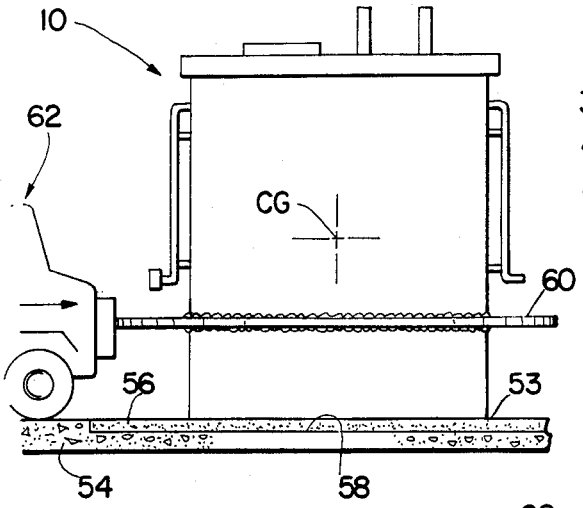
FIG. 3 is a schematic illustration of the container structure of the invention, showing a vehicle delivering an external impact thereto.
Figure 4:
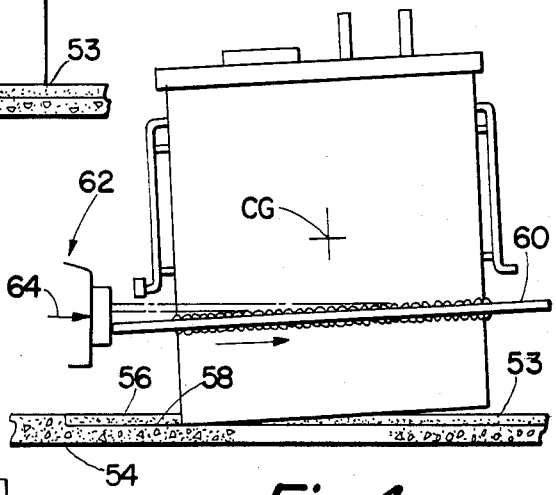
FIG. 4 is a schematic illustration of the container structure of the invention, showing the manner in which it initially reacts to the impact.
Figure 5:
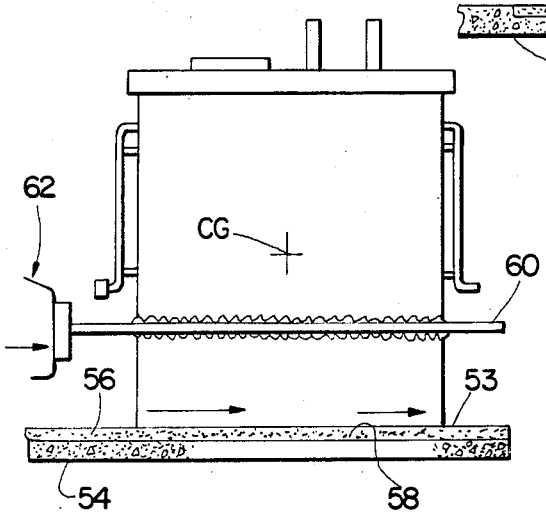
FIG. 5 is a schematic illustration of the container structure of the invention, showing its further reaction to the impact.

FIGS. 3–5 schematically illustrate the manner in which a container structure 10 according to the invention reacts to a large impact by a vehicle. In FIGS. 3–5 the vehicle is schematically illustrated at 62, and the arrow 64 depicts the direction in which the vehicle 62 impacts against the container structure 10. The initial impact of the vehicle is against the annular rim 60. The impact force is transmitted through the rim 60 to the container structure along a line of action that extends below the center of gravity C.G. of the container structure. This causes a moment $M_1$ to be applied to the container structure, in the direction shown in FIG. 4. That moment $M_1$ causes the side of the container structure remote from the point of impact to initially pivot or tilt, in the manner depicted in FIG. 4. The rim 60 projects far enough outwardly from the outer container 14 such that even when the container structure tilts, the cylindrical wall 24 of the outer container should not contact the vehicle 62. After initially tilting, the container structure 10 will begin to slide on the support surface 53, as illustrated schematically in FIG. 5. It is believed that the ability of the container structure to tilt, in the manner illustrated in FIG. 4, is important to initiating the sliding movement of the container structure. Specifically, by tilting in the manner depicted by FIG. 4 the container structure will slide readily along the support surface 53, as shown in FIG. 5 without digging into the support surface.

Figure 6:
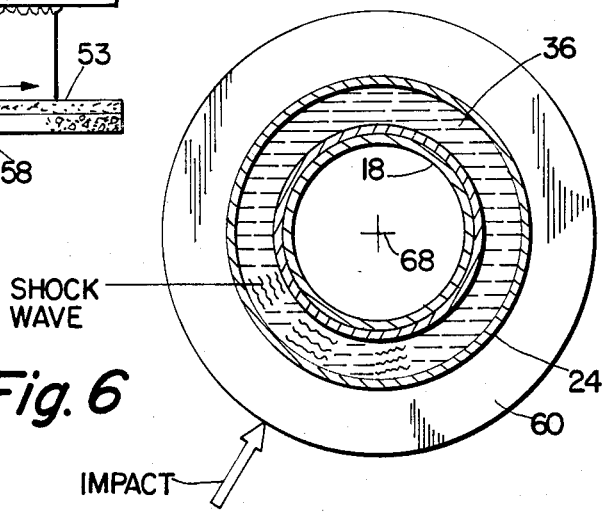
FIG. 6 is a schematic illustration of the force resolution on the container structure in response to an external impact.

FIG. 6 further illustrates the force resolution on the contents of the container structure during an impact. An impact against the rim 60 is applied to the side wall 24 of the outer container. With the liquid completely filling the fluid chamber 36, and substantially confined in the chamber 36, shock waves are transmitted through the liquid in chamber 36 and against the outer surface of the side wall 18 of the inner container. Because minimal, if any, liquid can be extruded from the chamber 36 there is little, if any, opportunity for displacement of the liquid. The shockwaves distribute the impact force over a large area of the inner container, and there is little relative movement of the inner container 12 relative to the outer container 14. This enables the entire container structure 10 to react as a solid body to the impact. For example, if the container structure is not impacted along a diametric line, then the container structure may also turn about its central axis 68 as it slides along the support surface 53.

As discussed above, the container structure of the invention is also designed to dissipate the heat of an external fire, to minimize the likelihood of damage to the contents of the inner compartment. As disclosed in U.S. Pat. No. 4,469,129, there is preferably a layer of closed cell glass insulation 74 (FIGS. 1, 2) secured to the side wall 18 of the inner container 12. Thus, the body of aqueous liquid in the fluid chamber 36, and the layer of closed cell insulation 74 are disposed between any fire and the contents of the inner container 12.

Further, the Woods Metal plugs 51 disposed in the openings 50 in the wall means 28, are designed to melt at a specific temperature (e.g. 71° C.), well below the normal boiling point of water. When the plugs 51 melt, the openings 50 communicate the fluid chamber 36 with the vent space 38. Accordingly, well before the temperature of the aqueous liquid gets to the boiling point of water, the metal plugs 51 will melt out of the openings 50, thereby allowing the fluid chamber 36 to be vented to the atmosphere through the vent space 38. This concept is important because, by venting the fluid chamber 36 to the atmosphere, the temperature against the outside of the insulation layer 74 will remain at, or substantially close to, the boiling point of water for virtually the entire period that it takes the liquid in the fluid chamber 36 to evaporate. During that period, the closed cell insulation 74 restricts heat transfer to the inner container 12, and the temperature against the insulation 74 is limited by the temperature of the boiling water. Thus, a very favorable temperature gradient is provided between the fire and the contents of the inner container, for the entire period that the liquid in the fluid chamber 36 is evaporating.

While the Woods Metal plugs 51 are preferred for communicating the fluid chamber 36 with the vent space 38, it is contemplated that other ways of communicating the fluid chamber with the vent space may also be used. For example, aneroid thermostat means, or gates with fusible latches may be so utilized. Further, it is believed that, in light of the present disclosure, other means for communicating the fluid chamber with the vent space will be apparent to those of ordinary skill in the art.

Thus, applicants have provided what is believed to be a unique container structure for a dangerous material. In the disclosed embodiment the dangerous material is gasoline, but the principles of this invention are not limited to that type of material. The manner in which the principles of this invention can be used to provide a container structure for dangerous material such as pesticide, toxic waste, etc. will be readily apparent to those of ordinary skill in the art.

What is claimed is:

1. Apparatus comprising a support surface and a container structure for a dangerous material slidably disposed on said support surface, said container structure comprising an inner container defining a chamber for receiving the dangerous material, an outer container surrounding the inner container, a fluid chamber disposed between said inner and outer containers, means defining a vent space disposed between said inner and outer containers in the area above said fluid chamber, wall means separating and sealing said fluid chamber from said vent space, a normally static body of non-flammable liquid completely filling said fluid chamber and being substantially confined in said fluid chamber, the outer container having a bottom wall adapted to slidably engage said support surface so that the container structure can slide on the support surface in response to an external impact overcoming its inertia, the fluid chamber surrounding said inner container and extending from the bottom wall of the outer container to the wall means separating and sealing the fluid chamber from the vent space so that the normally static body of liquid in said fluid chamber applies pressure completely around the inner container over a height that corresponds to the height of the fluid chamber, thereby distributing the force of an impact over the inner container, and enabling the container structure to slide as a solid body on the support surface in response to an external impact which overcomes its inertia, normally closed venting means associated with said wall means and responsive to the temperature of said non-flammable liquid for opening communication between said fluid chamber and said vent space when the temperature of the non-flammable liquid reaches a predetermined level.

2. Apparatus as defined in claim 1 including one or more openings in said wall means and a respective plug disposed in each opening in said wall means to seal each opening and form said venting means, each plug being adapted to melt out of its respective opening when the temperature of the liquid in the fluid chamber exceeds said predetermined temperature level.

3. Apparatus as defined in claim 1 including an impact ring connected with said outer container and extending outwardly therefrom, said impact ring being adapted to engage an object moving toward said container structure so that forces imparted to the container structure from the member are transmitted through the impact member.

4. Apparatus as defined in claim 3 wherein said impact ring is disposed so that the line of action of impact forces applied thereto are directed substantially beneath the center of gravity of said container structure.

5. Apparatus as defined in claim 4 wherein the impact ring is disposed above the bottom of the outer container and below the center of gravity of said container structure.

6. A container structure for a dangerous material, comprising an inner container defining a chamber for receiving the dangerous material, an outer container surrounding the inner container, a fluid chamber disposed between said inner and outer containers, means defining a vent space disposed between said inner and outer containers in the area above said fluid chamber, a non-flammable liquid completely filling said fluid chamber and being statically confined in said fluid chamber, the outer container having a bottom wall adapted to slidably engage a support surface so that the container structure can slide on the support surface in response to an external impact overcoming its inertia, the fluid chamber surrounding the inner container so that the non-flammable liquid substantially confined in and completely filling said fluid chamber distributes the force of an impact over the inner container and enables the container structure to slide as a solid body on the support surface in response to an external impact which overcomes its inertia, said container structure including an impact ring connected with said outer container and extending outwardly therefrom and disposed beneath the center of gravity of said container structure and above the bottom of said container structure, said impact ring surrounding the outer wall of the outer container, said impact ring being adapted to engage an object moving toward said container structure so that forces imparted to the outer container from the member are transmitted through the impact member, means for restricting communication between said fluid chamber and said vent space comprising wall means disposed between said fluid chamber and said vent space, sealing means for sealing said wall means against passage of vapor from said fluid chamber while the temperature of the liquid is below a predetermined level and for allowing passage of vapor from said fluid chamber to said vent space, when the temperature of the liquid is above said predetermined temperature level.

7. A container structure as defined in claim 6 including an impact ring connected with said outer container and extending outwardly therefrom, said impact ring surrounding the outer wall of the outer container, said impact ring being adapted to engage an object moving toward said container structure so that forces imparted to the outer container from the member are transmitted through the impact member.

8. A container structure as defined in claim 7 wherein said impact ring is disposed so that the line of action of impact forces applied thereto extends beneath the center of gravity of said container structure.

9. A container structure as defined in claim 8 wherein the impact ring is disposed above the bottom of the outer container and below the center of gravity of said container structure.

10. A container structure as defined in claim 6 including one or more openings in said walls means, said sealing means comprising a respective plug disposed in each opening in said wall means, each plug being adapted to melt out of its respective opening when the temperature of the liquid in the fluid chamber exceeds said predetermined temperature level.

11. A container structure for a dangerous material, comprising an inner container defining a chamber for receiving the dangerous material, an outer container surrounding the inner container, a fluid chamber disposed between said inner and outer containers, means defining a vent space disposed between said inner and outer containers in the area above said fluid chamber, a non-flammable liquid completely filling said fluid chamber and being statically confined in said fluid chamber, the outer container having a bottom wall adapted to slidably engage a support surface so that the container structure can slide on the support surface in response to an external impact overcoming its inertia, the fluid chamber surrounding the inner container so that the non-flammable liquid substantially confined in and completely filling said fluid chamber distributes the force of an impact over the inner container and enables the container structure to slide as a solid body on the support surface in response to an external impact which overcomes its inertia, means for restricting fluid communication between said fluid chamber and said vent space comprising wall means disposed between said fluid chamber and said vent space, sealing means for sealing said wall means against passage of vapor from said fluid chamber to said vent space while the temperature of the liquid is below a predetermined level and for allowing passage of vapor from said fluid chamber to said vent space when the temperature of the liquid is above said predetermined temperature level.

12. A container structure as defined in claim 11 including one or more openings in said walls means, said sealing means comprising a respective plug disposed in each opening in said wall means, each plug being adapted to melt out of its respective opening when the temperature of the liquid in the fluid chamber exceeds said predetermined temperature level.

13. A container structure for a dangerous material comprising an inner container defining a chamber for receiving the dangerous material, an outer container surrounding the inner container, a fluid chamber disposed between said inner and outer containers in the area above said fluid chamber, the outer container having a bottom wall adapted to slidably engage a support surface so that the container structure can slide on the support surface in response to an external impact overcoming its inertia, means for substantially restricting a flow of liquid from said fluid chamber to said vent space, and means communicating with the vent space and the interior of said fluid chamber and adapted to establish a predetermined level of communication between said fluid chamber and said vent space when the temperature thereof reaches a predetermined level, said container structure including an impact ring connected with said outer container and extending outwardly therefrom, said impact ring being disposed above the bottom of the outer container and below the center of gravity of said container structure, said impact ring surrounding the outer wall of the outer container, said impact ring being adapted to engage an object moving toward said container structure so that forces imparted to the outer container from the member are transmitted through the impact member, said means for restricting flow of liquid from said fluid chamber to said vent space comprising wall means disposed between said fluid chamber and said vent space, said means communicating with the vent space and the interior of the fluid chamber comprising sealing means for sealing said wall means against passage of vapor from said fluid chamber while the temperature of a liquid in the fluid chamber is below a predetermined level and for allowing passage of vapor from said fluid chamber to said vent space when the temperature of a liquid in the fluid chamber is above said predetermined temperature level.

* * * * *